United States Patent [19]

Bengtsson

[11] Patent Number: 4,858,526

[45] Date of Patent: Aug. 22, 1989

[54] HAND STAMP

[76] Inventor: Lars Bengtsson, 512 00 Svenljunga, 13, Lysjövägen, Sweden

[21] Appl. No.: 166,019

[22] Filed: Mar. 9, 1988

[51] Int. Cl.[4] ..... B41J 1/60

[52] U.S. Cl. ..... 101/111

[58] Field of Search ..... 101/103, 111, 104, 105, 101/110

[56] References Cited

U.S. PATENT DOCUMENTS

| | | | |
|---|---|---|---|
| 2,075,169 | 3/1937 | Brown | 101/103 X |
| 4,064,802 | 12/1977 | Funahashi | 101/105 X |
| 4,149,459 | 4/1979 | Flynn et al. | 101/103 |
| 4,492,162 | 1/1985 | Nettesheim et al. | 101/103 |
| 4,561,353 | 12/1985 | Chapman et al. | 101/111 |
| 4,697,513 | 10/1987 | Fabes | 101/111 |

FOREIGN PATENT DOCUMENTS

| | | | |
|---|---|---|---|
| 167037 | 4/1950 | Austria | 101/111 |

*Primary Examiner*—Edgar S. Burr
*Assistant Examiner*—Moshe I. Cohen
*Attorney, Agent, or Firm*—Finnegan, Henderson, Farabow, Garrett & Dunner

[57] ABSTRACT

A hand stamp comprises a casing which in the lower portion thereof has a printing member for producing an invariable text such as the name of a company, a logotype or the like and further houses a printing unit which is vertically displaceable in said casing and comprises a belt with a plurality of separate printing blocks which selectively may be shifted by means of shifting wheels. Said printing unit can be locked in an upper position in which the shifting wheels are accessible for setting through an opening in the casing. A compression spring normally keeps the printing unit in a lower active position in which the printing surface thereof is located beneath the printing surface giving the invariable text to allow said printing unit to make an imprint before the invariable text is printed and with a printing pressure solely obtained by said compression spring. In the lower position of the printing unit the shifting wheels thereof are not accessible through the opening in the casing.

8 Claims, 2 Drawing Sheets

HAND STAMP

FIELD OF THE INVENTION

The present invention refers to a hand stamp. More specifically the invention refers to hand stamps of the kind which include endless belts preferably running over upper and lower support members and each having a plurality of consecutive stamping blocks and setting means to move said belts to selectively bring the stamping blocks of the various belts into register with each other and/or into a position in which stamping may be executed.

DESCRIPTION OF THE RELATED ART

The hand stamps of the kind referred to which have been brought into the market all have drawbacks which considerably reduce the utility thereof.

Such a drawback is that the setting in many cases has to be carried out with the hand stamp in an upside down position and by means of setting wheels which are difficult to reach or by bringing the belts into the desired position by means of a pen or similar object.

In some embodiments the stamp has to be dismantled in order to be set.

A further drawback is that the belts which carry the stamping blocks usually are not secured in distinct positions rendering it difficult to obtain stamp prints which are correctly aligned.

A third drawback is that during the setting procedure the intended stamp print has to be read on the printing surfaces of the stamping blocks said printing surfaces having a poor contrast and further display the text in a reversed fashion. To make sure that the proper text has been set it is necessary to make a test printing.

A still further drawback is that most of the stamp constructions with shiftable text hitherto known are not well suited for so called self-inking stamping blocks i.e. stamping blocks not requiring a stamp pad.

SUMMARY OF THE INVENTION

The object of the invention thus is to provide a hand stamp of the kind referred to which does not have the drawbacks mentioned and which additionally gives the best possible printing results and may be produced at a relatively low cost in an elegant and easy-to-operate design, in which the printing unit is housed in an attractive casing.

In order to accomplish these and further objects the invention has the characteristics of the claims.

BRIEF DESCRIPTION OF THE DRAWINGS

The accompanying drawings, which are incorporated in and constitute a part of the specification, illustrate preferred embodiment of the invention and, together with the general description given above and the detailed description of the preferred embodiment given below, serve to explain the principles of the invention.

FIG. 1 is a side elevational view of a date stamp according to the invention and shown in a position ready for stamping while

DESCRIPTION OF THE PREFERRED EMBODIMENT

Figure 1:
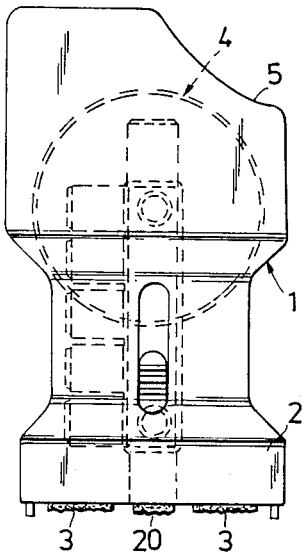

Reference will now be made in detail to the present preferred embodiment of the invention as illustrated in the accompanying drawings.

Although the invention is not limited thereto the hand stamp here described and illustrated refers to a hand stamp having pre-inked stamping blocks i.e. stamping blocks which are manufactured by using a microporous material capable of holding such a quantity of printing ink that stamping may be accomplished without the use of a stamp pad. By using materials of this kind it is today possible to manufacture stamps capable of giving ten thousands of prints without re-inking.

Further, the invention will be examplified as a date stamp but it is obvious that the invention is not restricted thereto and that it is possible to consider a plurality of stamp combinations having one or several belts or wheels provided with stamping blocks or stamping types.

The hand stamp illustrated in the drawing is a so called date stamp which in addition to a stationary text can produce a variable text in the shape of a date print. According to the illustrated embodiment the hand stamp comprises an outer casing, being generally designated as 1 and which is of such a shape that it forms the shaft of the stamp but also the base portion 2 thereof. In the latter two printing blocks 3 are arranged.

Within the outer casing 1 there is vertically displaceably provided a printing unit generally designated as 4. The outer casing has in the upper portion thereof an opening 5 through which access to setting wheels 6 for the stamps of the printing unit is possible in the shifting position according to FIG. 2.

When the stamp is in the stamping position shown in FIG. 1 these setting wheels are not accessible through the opening 5.

When the hand stamp is used the printing blocks 3 will create a certain print, for instance the name of a company and a designation of a place while the printing unit 4 which is in the position according to FIG. 1 will create a selectable stamp print designating the date.

Figure 2:
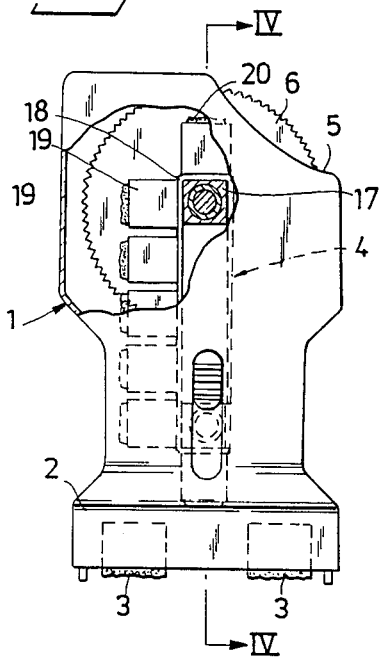
FIG. 2 is a side elevational view showing the stamp in a setting position.

From the description above it should be evident that the setting of the variable text is effected by turning the wheels 6 which are accessible in the setting position according to FIG. 2 and that the risk of unintended change of date denotation has been eliminated due to the fact that the stamping unit immediately upon shifting has been brought to a position where the setting wheels are protected against unintended manipulation inside the stamp cover 1.

The construction of the hand stamp will now be described more in detail.

Figure 5:
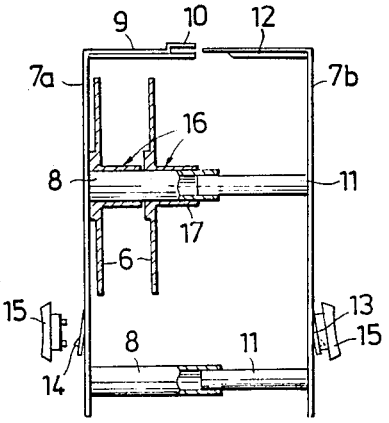
FIG. 5 shows a partial front view of a stamping unit forming part of the hand stamp.
Figure 6:
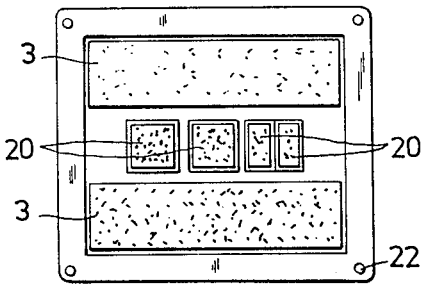
FIG. 6 shows the lower part of the hand stamp seen from below.

The printing unit 4 comprises according to FIG. 5 -in which the parts of the unit for the sake of clarity are shown somewhat separated- an invertedly U-shaped yoke, the mutually parallel flanges of which are designated as *7a* and *7b*. The printing unit 4 as well as the other essential parts of the hand stamp are preferably made from a plastic material in an injection molding process. Formed in one piece with the flange *7a* are arranged at a distance from each other two tubular sockets 8 and an upper portion 9 having an upwardly directed part 10. The flange 7*b* comprises in a similar manner two studs 11 which fit into the tubular sockets 8 and an upper portion 12 which is provided to be connected to the upper portion 9 of the flange 7*a*, for instance due to a dovetail complementary design of the parts in question.

Integral with the flanges 7*a* and 7*b* are resilient tongues 13 which are formed to catches 14 adjacent to the free ends thereof. Connected to said tongues are control knobs 15. The latter comprise for cooperation with the tongues pins provided to be inserted into corresponding holes in the tongues. The tubular sockets 8 serve to rotatably support a plurality of support members 16, which according to FIG. 2 each have a hub 17 of square outer section and a circular hole.

The upper support members further each have a circular disk integrally formed with said hub, constituting a setting wheel as described.

The object of the support members is to support an endless belt 18, which has a plurality of equidistantly arranged holders 19 for preinked stamping blocks 20. If the belt is made from a plastic material with flexible properties such as polythylene, the belt and the holders may be produced in one single piece.

Figure 4:
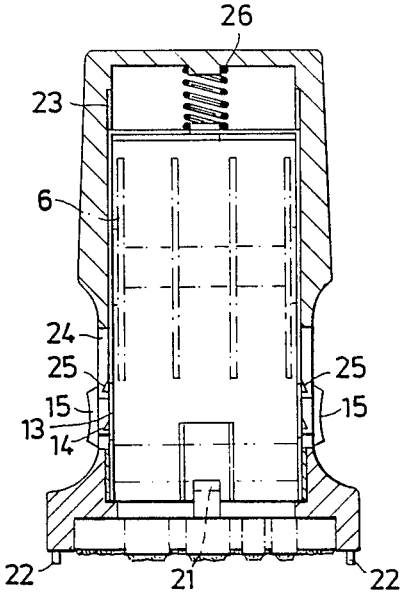
FIG. 4 is a partial section along line IV—IV as shown in FIG. 2.

As appears from FIG. 4 the outer casing 1 of the hand stamp comprises an upper part and a lower part 2 which are mutually connected by means of a snap connection 21. In this manner it will be possible to use one single upper member for a plurality of base members of various sizes.

The base member further comprises resilient supports 22 known per se and which may consist of pins which by means of spring force are held in the illustrated position but which against the action of the spring force may be retracted during the printing operation.

The outer casing 1 in the opposite side walls thereof is provided with internal recesses 23 for guiding the flanges 7*a*, 7*b* and two openings 24 through which the outer part of the control knobs 15 project. The recesses are wider than the openings 24 and outside the latter there are provided in the inner sides of the outer casing notches 25, with which the catches 14 may lockingly cooperate in a manner to be described.

Figure 3:
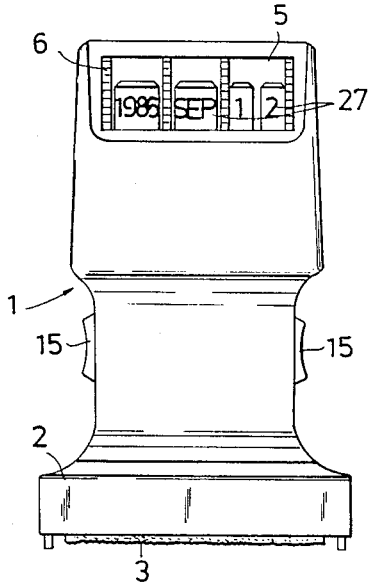
FIG. 3 is a front view of the stamp shown in FIG. 1 and 2.

As described the upper part of the printing unit 4 has an upwardly directed portion 10 and this one and a corresponding downwardly directed portion extending from the upper part of the casing constitute a guide for a compression spring 26. The flanges of the holders 19 may have printed thereon designation 27 indicating the text of the holder which is in printing position. Since the opening 5 is dimensioned such that only one line of said holders is visible, the flanges of these holders should not show the text which said holders will print but the text which the holders being in printing position have. As already indicated the printing unit 4 is in the position shown in FIG. 2 when the text is changed. This changing is carried out by turning the wheels 6 accessible through the opening 5 and the text thus set directly appears in the opening 5, as shown in FIG. 3. The printing unit is kept in this inoperative retracted position due to the fact that the catches 14 thereof engage the notches 25 in the outer casing 1.

After setting, the knobs 15 are pressed inwardly which makes it possible for the compression spring 26 to press down the entire printing unit to the lower end position shown in FIG. 4. In this operative end position the printing blocks 20 project slightly more than the stationary printing blocks 3, but the lower, active surface is situated above the surface upon which the stamp rests to avoid undesired prints, due to the resilient supports 22.

In the printing operation the printing blocks 20 will thus first come into action. The entire printing unit 4 is however displaceable against the action of the compression spring 26, which is comparatively weak, and consequently the printing blocks 3 may come to action at the same time as the printing blocks 20 are pressed with a suitable pressure against the surface upon which the stamp rests.

Especially when the invariable text which is to be produced by means of the printing blocks 3 contains logotypes or similar characters requiring a relatively high printing pressure it is important that the date printing blocks 20 which give sharp prints require a very low printing pressure and are not influenced by such a high pressure, but rather are pressed against the object to be printed with the calibrated force of the weak spring 26.

After a period of use pre-inked printing blocks need to be more compressed to give perfect prints but this need varies with the area of the text. Should the date text be influenced by the pressure required for the invariable text the result would be blurred prints. Also in this respect the printing of the date characters by the aid of the weak spring 26 is of great importance.

Additional advantages and modifications will readily occur to those skilled in the art. The invention in its broader aspects is, therefore, not limited to the specific details, representative apparatus and illustrative example shown and described. Accordingly, departures may be made from such details without departing from the spirit or scope of applicant's general inventive concept.

What is claimed is:

1. A hand stamp, comprising:

a hollow casing having a print support portion and a handle portion with an aperture therein;

first printing means for printing an invariable text fixedly mounted in the print support portion and defining a first print surface;

resilient supports for normally supporting the defined first print surface a first predetermined distance out of printing engagement with a printable face;

second printing means for printing a variable text, including a frame slidably mounted in the casing along an axis substantially perpendicular to the defined first print surface, a plurality of endless belts laterally spaced along and rotatable on a pair of spaced axes substantially parallel to the defined first print surface, the belts supporting a plurality of spaced printing blocks, a plurality of adjusting wheels rotatably mounted on one of said axes for moving a respective endless belt to position a selected printing block in registry with the defined first print surface;

limiting means for limiting the axial movement of the frame in one direction toward the handle portion to a setting position and in the opposite direction toward the defined first print surface to a printing position, said limiting means and said printing blocks being dimensional to define a second print surface in registry with the defined first print surface at times when the frame is in the printing position;

spring means mounted in the casing for urging the frame to the printing position; and locking means for releasably locking the frame in the setting position against the urging of the spring means;

said adjusting wheels having a peripheral surface more accessible from said aperture when the frame is in the setting position, and less accessible from said aperture when the frame is in the printing position;

said handstamp operative against the urging of the resilient supports to apply the defined second print surface to the printable face against the urging of the spring means, and to apply the defined first print surface against the printable face in registry with said defined second print surface.

2. The hand stamp of claim 1, wherein the defined second print surface is disposed a second predetermined distance, less than the first predetermined distance, out of printing engagement with the printable face when the frame is in the printing position.

3. The hand stamp of claim 1, wherein the endless belts each include a printing block holder comprised of a microporous pre-inked material.

4. The hand stamp of claim 1, wherein the spaced axes supporting the belts are rotatably mounted in the frame and have square outer surfaces for supporting said belts.

5. The hand stamp of claim 1, wherein the frame includes two end pieces mutually connected by means of tubular interengageable portions serving to rotatably support the axes for the belts.

6. The hand stamp of claim 1, wherein said locking means includes side openings in the casing, knobs extending through the openings and secured to resilient tongues provided with catches and forming parts of end pieces of the frame, and further having notches in the casing for cooperation with said catches to releasably lock said frame in said setting position.

7. The hand stamp of claim 1, wherein the printing blocks each expose one surface through the aperture in the casing when the frame is in the setting position, and each exposed surface bears the same text as the corresponding printing block of the defined second printing surface which is in registry with the defined first printing surface when the frame is in the printing position.

8. The hand stamp of claim 1, wherein the handle portion and the printing portion of the casing are integrally joined by an intermediate portion of substantially reduced cross-sectional area for gripping the casing.

* * * * *